US005111250A

United States Patent [19]

Kashiwagi

[11] Patent Number: 5,111,250

[45] Date of Patent: May 5, 1992

[54] HEAT-FIXING DEVICE HAVING A ROLLER SELECTIVELY LOADED THROUGH AN ELASTIC ELEMENT

[75] Inventor: Hiromi Kashiwagi, Fukaya, Japan

[73] Assignee: Hitachi Metals, Ltd., Tokyo, Japan

[21] Appl. No.: 698,162

[22] Filed: May 9, 1991

[30] Foreign Application Priority Data

May 10, 1990 [JP] Japan ..... 2-120391

[51] Int. Cl.[5] ..... G03G 15/20

[52] U.S. Cl. ..... 355/285; 100/171; 219/216; 355/290

[58] Field of Search ..... 355/282, 285, 290, 295; 219/216, 469; 432/60; 100/93 RP, 171, 176

[56] References Cited

U.S. PATENT DOCUMENTS

| | | | |
|---|---|---|---|
| 4,168,424 | 9/1979 | Kasahara et al. | 219/469 |
| 4,428,660 | 1/1984 | Matsumoto | 432/60 X |
| 4,473,290 | 9/1984 | Iwao | 219/216 X |
| 4,963,941 | 10/1990 | Negishi et al. | 355/282 |
| 5,017,970 | 5/1991 | Sakata | 355/290 |
| 5,023,667 | 6/1991 | Negoro et al. | 355/282 X |

FOREIGN PATENT DOCUMENTS 57-76582A 5/1982 Japan .

*Primary Examiner*—A. T. Grimley
*Assistant Examiner*—William J. Royer
*Attorney, Agent, or Firm*—Finnegan, Henderson, Farabow, Garrett & Dunner

[57] ABSTRACT

A heat-fixing device for heating a toner image on a sheet-like member includes a rotatable heating roller for heating the sheet and a rotatable pressing roller for pressing the sheet-like member against the heating roller, the longitudinal axis of one of the heating roller and the pressing roller being fixed to a frame and the longitudinal axis of the other roller being not fixed to the frame. A guide arm swingable on a swing axis fixed to the frame and supporting the other roller is provided at a position distant from the swing axis to guide the movement of the other roller in relation to the fixed roller, and a moving arm and an elastic element arranged between the guide arm and the moving arm are also provided so that the moving arm drives the guide arm through the elastic element to press the sheet-like member between the heating roller and the pressing roller. An internal groove-cam follower surface in the moving arm enables the pressing force between the heating roller and the pressing roller to be adjusted in accordance with a movement of the moving arm when the pressing roller and the heating roller are in contact with each other.

7 Claims, 1 Drawing Sheet

HEAT-FIXING DEVICE HAVING A ROLLER SELECTIVELY LOADED THROUGH AN ELASTIC ELEMENT

BACKGROUND OF THE INVENTION AND RELATED ART STATEMENT

The present invention relates to a heat-fixing device in which a toner image formed on paper or like sheets passes between heating and pressing rollers to be fixed to the sheet.

A conventional heat-fixing device includes a heating roller and a pressing roller. The heating roller includes a core which is made of materials with good thermal conductivity such as aluminum alloy, stainless steel or iron alloy, etc. and is heated by a heating source such as an infrared lamp, halogen lamp or Nichrome wire, etc. and an anti-adhesive and heat-resistant surface which is made of a fluorine contained polymer (PTFE or PFA or the like). The pressing roller is coated with an elastic heat-resistant material (silicone rubber or fluoro rubber, etc.). In the conventional heat-fixing device, if the pressing roller is always pressed against the heating roller, a contact portion therebetween, particularly a cross-sectional shape of the pressing roller deforms so that a smooth and effective fixing operation cannot be carried out. Therefore, the heating roller and the pressing roller contact with each other only when the toner image on the sheet such as plain paper, photosensitive paper, etc. is pressed therebetween, and are separated from each other when the sheet is not pressed therebetween or the sheet jams, as disclosed in Publication of Japanese Patent Laid-open No. 57-76582.

In the conventional heat-fixing device as shown in FIG. 2, the heating roller 103 with the heating source 102 contacts with the pressing roller 104 to form a nip portion 115 for passing the sheet (not shown) along the pass line 101 by rotation of the heating roller 103 and the pressing roller 104. An arm 105 is rotatable through a pin 108 fixed to an end thereof and supports a shaft 107 of the pressing roller 104 through a groove 106 at an intermediate portion of the arm 105. A rotatable roller 110 is arranged at another end of the arm 105 and is in constant contact with an eccentric cam 109. The pin 108 is movable in a guide groove 112 on a frame 111 and is urged by a tension spring 114 toward a hanger 113 so that the pressing roller 104 is pressed against the heating roller 103. When the sheet is pressed between the heating roller 103 and the pressing roller 104 to fix the toner image thereon, the largest radius portion of the eccentric cam 109 contacts with the roller 110 to press the pressing roller 104 against the heating roller 103. When the sheet is not pressed between the heating roller 103 and the pressing roller 104 or when the sheet jams in the heat-fixing device, the eccentric cam 109 rotates by 180 degrees from the position shown in FIG. 2 and the smallest radius portion of the eccentric cam 109 contacts with the roller 110 to separate the pressing roller 104 from the heating roller 103. Since the tension coil spring 114 extends between the pin 108 supporting the arm 105 and a hanger 113 mounted on a frame (not shown) to press the pressing roller 104, a length for the spring 114 is large, an excessive space is necessary, and a size of the device is large. And, because of a variation in length of the tension coil spring 114 and/or a jam in engagement between the pin 108 and the guide groove 112, there is a possibility that a pressing operation of the pressing roller 104 is not released when the eccentric cam 109 rotates to separate the pressing roller 104 from the heating roller 103.

OBJECT AND SUMMARY OF THE INVENTION

The object of the present invention is to provide a heat-fixing device in which longitudinal axes of the pressing roller and the heating roller are kept accurately in a plane, a difference in pressing force of the pressing roller against the heating roller between a desired degree and an actual degree is small when one of the pressing roller and the heating roller moves in relation to another one, so that the contacting and separating movement is controlled smoothly and securely.

According to the present invention, a heat-fixing device for fusing a toner image on a sheet comprises a rotatable heating roller for heating the sheet and a rotatable pressing roller for pressing the sheet against the heating roller, wherein a longitudinal axis of one of the heating roller and the pressing roller is adapted to be fixed to a frame and a longitudinal axis of another one thereof is not fixed to the frame, the fixing heater device further comprises, guide arm means swingable on a swing axis fixed to the frame and supporting the another one of the heating roller and the pressing roller at a position distant from the swing axis to guide a movement of the another one of the pressing roller and the heating roller in relation to the fixed one thereof, and driving means including moving means and elastic means arranged between the guide arm means and the moving means so that the moving means drive the guide arm means through the elastic means to press the sheet between the heating roller and the pressing roller and a pressing force between the heating roller and the pressing roller is adjusted in accordance with a movement of the moving means when the pressing roller and the heating roller contact with each other.

Since the guide arm means swingable on the fixed swing axis support the another one of the heating roller and the pressing roller and the elastic means are arranged between the guide means and the moving means, a force generated from the elastic means deformed by the moving means is reduced only by a swing frictional loss of the guide arm means on the fixed swing axis and the force generated from the elastic means deformed by the moving means is not reduced by a straight slide frictional loss in a groove. Therefore, a difference in pressing force of the pressing roller against the heating roller between a desired degree and an actual degree is small in comparison with the prior art, and a movement of the another one of the heating roller and the pressing roller accurately corresponds to that of the moving member without a disturbance of the movement of the another one thereof by the straight slide frictional loss in the groove.

DETAILED DESCRIPTION OF PREFERRED EMBODIMENTS

Figure 1:
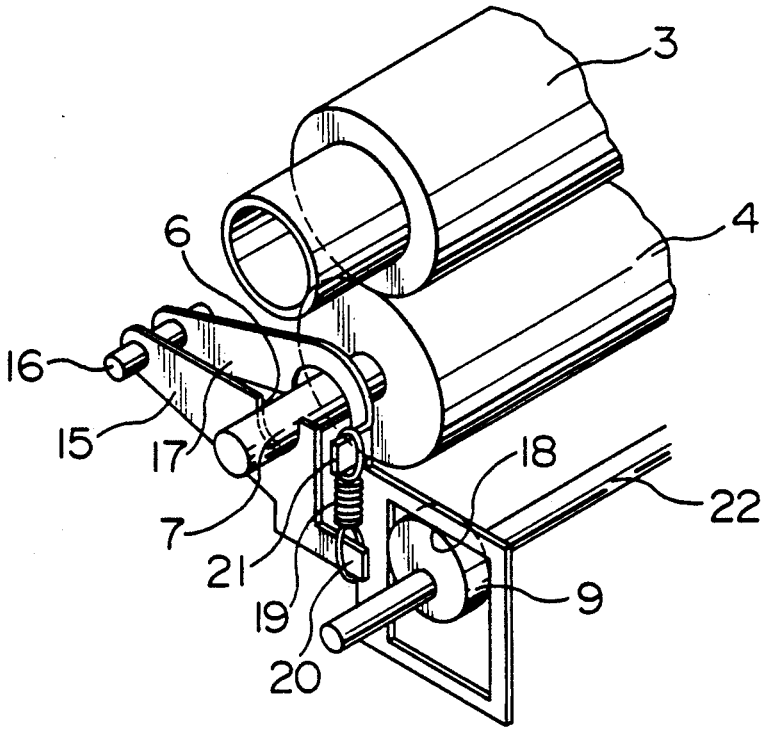
FIG. 1 is an oblique projection view showing a longitudinal end structure of a fixing heater device according to the present invention.
Figure 2:
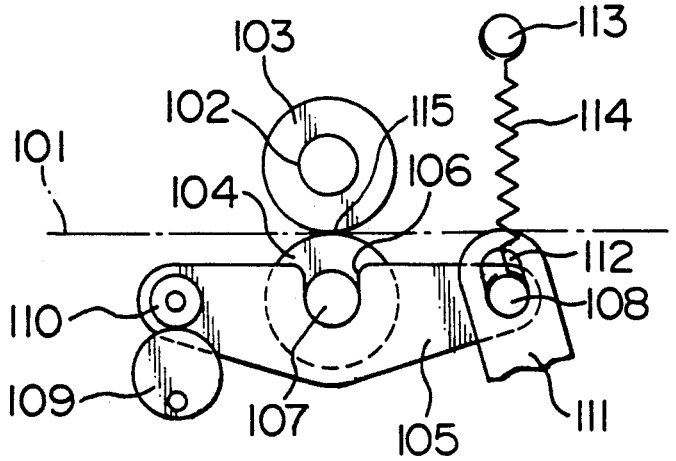
FIG. 2 PRIOR ART
FIG. 2 is an oblique projection view showing a longitudinal end structure of a fixing heater device of the prior art.

The structure shown in FIG. 1 may be arranged at either longitudinal end of a fixing heater device. In FIG. 1, an arm 15 as the guide arm means has a groove 6 at an intermediate portion thereof for supporting a shaft 7 of a pressing roller 4 in a rotatable manner and is swingable on a fixed pin 16 arranged at an longitudinal end of the arm 15 so that a longitudinal axis of the pressing roller 4 and a longitudinal axis of a heating roller 3 are kept in a plane to form a longitudinal contact line between the pressing roller 4 and the heating roller 3. A swing arm 17 as the moving member is swingable on the fixed pin 16 arranged at a longitudinal end of the swing arm 17 and includes a groove 18 which is arranged at another longitudinal end of the arm 17 and contacts with an eccentric cam 9 to be moved by rotation of the cam 9. A tension spring 19 as the elastic means extends between an engagement portion 20 of the arm 15 and an engagement portion 21 of the arm 17 so that the arm 15 is driven through the spring 19 by the arm 17. The cam 9 is connected to a rotational shaft 22 to be rotated. The heating roller 3 includes a heating source (not shown) of a halogen lamp or the like therein and a peripheral surface of PFA. The pressing roller includes a peripheral surface of silicone rubber.

In FIG. 1, the largest radius portion of the eccentric cam 9 contacts with an upper surface of the groove 18 of the arm 17 to keep the arm 17 at the highest position thereof and the arm 15 is drawn upwardly through the spring 19 by the arm 17 so that the pressing roller 4 is pressed against the heating roller 3 to heat toner image on a sheet and to fix the toner image to the sheet. Usually a line pressure between the heating roller 3 and the pressing roller 4 is 0.5 to 2 Kgf/cm.

In order to separate the pressing roller 4 from the heating roller 3 or to decrease the pressure between the heating roller 3 and the pressing roller 4 for preventing plastic deformation of the pressing roller 4 or for solving a sheet jamming, the cam connected to the shaft 22 is rotated from the position shown in FIG. 1 so that a radius less than the largest radius of the eccentric cam 9 contacts with the upper surface of the groove 18 of the arm 17 to keep the arm 17 at a position lower than the highest position of the arm 17. Therefore, a tension of the spring 19 is decreased to decrease the pressure between the heating roller 3 and the pressing roller 4 and the arm 15 descends to separate the pressing roller 4 from the heating roller 3.

The pressure between the heating roller 3 and the pressing roller 4 and a distance therebetween can be adjusted by rotational degree of the cam 9 and/or a spring constant. The spring 19 may be a compression spring when the arm 17 pushes the arm 15 for the pressing roller 4 toward the heating roller 3 through the spring 19. The arm 17 as the moving member may be moved by an electro-magnetic solenoid connected thereto at a position distant from the pin 16 or may be rotated by a rotational motor. The spring 19 may be arranged between an output forward end of the electromagnetic solenoid as the moving means and the arm 15 without the arm 17. The longitudinal axis of the pressing roller 4 may be fixed when the heating roller 3 is moved in relation to the pressing roller 4.

The combination of the eccentric cam 9 and the groove 18 for rotating the arm 15 may be replaced by another cam device. A positional relation between the spring 19 and the combination of the eccentric cam 9 and the groove 18 may be changed so that the spring 19 is arranged between free ends of the arms 15 and 17 and the combination of the eccentric cam 9 and the groove 18 is arranged between the free end and the pin 16. In the heat-fixing device according to the present invention, the heating roller 3 and the pressing roller 4 may have respective publicly-known structures other than the above disclosure.

What is claimed is:

1. A heat-fixing device for heating a toner image on a sheet-like member comprising a rotatable heating roller for heating the toner image and a rotatable pressing roller for pressing the sheet-like member against the heating roller, wherein a longitudinal axis of one of the heating roller and the pressing roller is fixed and a longitudinal axis of another one thereof is not fixed, the heat-fixing device further comprises, guide arm means swingable on a swing axis and supporting the another one of the heating roller and the pressing roller at a position distant from the swing axis to guide a movement of the another one of the pressing roller and the heating roller in relation to the fixed one thereof so that the longitudinal axes of the pressing roller and the heating roller are kept on a plane to form a longitudinal contact line between the pressing roller and the heating roller, and driving means including moving means and elastic means arranged between the guide arm means and the moving means so that the moving means drive the guide arm means through the elastic mans to press the sheet-like member between the heating roller and the pressing roller, and wherein a pressing force between the heating roller and the pressing roller is adjusted in accordance with a movement of the moving means when the pressing roller and the heating roller are in contact with each other.

2. The heat-fixing device according to claim 1, wherein the moving means include a moving member movable to drive the guide arm means through the elastic means and an eccentric cam which contacts the moving member and rotates to move the moving member in accordance with the rotational degree of the eccentric cam when the heating roller and the pressing roller are in contact with each other.

3. The heat-fixing device according to claim 2, wherein the moving member is swingable on a swing axis and is moved by the eccentric cam at a position spaced apart from the swing axis.

4. The heat-fixing device as in claim 2, wherein said moving member includes an internal groove for cam-following contact with said eccentric cam.

5. A heat-fixing device for heating a toner image on a sheet-like member, comprising, a rotatable heating roller, a rotatable pressing roller facing the heating roller to form a transferring path for the sheet-like member, arm means which supports bearing portions of longitudinal ends of the pressing roller and are rotatable on a support axis, driving arm means rotatable on the support axis, cam means for rotating the driving arm means, and spring means arranged between the arm means and the driving arm means, wherein a pressing force between the heating roller and the pressing roller is adjusted in accordance with a movement of the driving arm means rotated by the cam means when the heating roller and the pressing roller are in contact with each other.

6. A heat-fixing device according to claim 5, wherein the cam means is an eccentric cam which contacts the driving arm means and rotates to move the driving arm means in accordance with the rotational degree of the eccentric cam when the heating roller and the pressing roller are in contact with each other.

7. The heat-fixing device as in claim 6, wherein said driving arm means includes cam-follower means surrounding said eccentric cam.

* * * * *